US005089217A

United States Patent [19]

Corpora et al.

[11] Patent Number: 5,089,217

[45] Date of Patent: Feb. 18, 1992

[54] CLEAN-UP SUB-SYSTEM FOR CHEMICAL DECONTAMINATION OF NUCLEAR REACTOR PRIMARY SYSTEMS

[75] Inventors: Gary J. Corpora; James S. Schlonski, both of Monroeville; Frank I. Bauer, Perry Township, Lawrence County; Phillip E. Miller, Greensburg, all of Pa.

[73] Assignee: Westinghouse Electric Corp., Pittsburgh, Pa.

[21] Appl. No.: 621,129

[22] Filed: Nov. 26, 1990

[51] Int. Cl.[5] ..... G21C 19/42

[52] U.S. Cl. ..... 376/313; 376/310; 376/309; 376/314

[58] Field of Search ..... 376/313, 310, 314, 315, 376/309; 210/665, 108, 206; 134/110, 111

[56] References Cited

U.S. PATENT DOCUMENTS

| | | | |
|---|---|---|---|
| 3,250,703 | 5/1966 | Levendusky | 210/660 |
| 4,105,556 | 8/1978 | D'Amaddio et al. | 210/206 |
| 4,437,933 | 3/1984 | Kikkawa et al. | 159/17.1 |
| 4,510,755 | 4/1985 | Gartmann et al. | 60/657 |
| 4,587,043 | 5/1986 | Murray et al. | 376/313 |

*Primary Examiner*—Brooks H. Hunt
*Assistant Examiner*—Meena Chelliah

[57] ABSTRACT

A unique clean-up sub-system for chemical decontamination of nuclear reactor primary systems is disclosed. Chemically-processed fluids containing suspended and dissolved solids are directed through a back-flushable filter and, thereafter, through one or more cartridge filters. After this initial filtering of suspended solids, the process fluid is directed to one or more demineralizer banks for removal of dissolved solids, followed by additional cartridge filtering to remove any resin fines carried out of the demineralizer banks. After final filtering, the process fluids are returned to the primary system, with or without chemical injection.

17 Claims, 2 Drawing Sheets

CLEAN-UP SUB-SYSTEM FOR CHEMICAL DECONTAMINATION OF NUCLEAR REACTOR PRIMARY SYSTEMS

BACKGROUND OF THE INVENTION

1. Field Of The Invention

The present invention relates to the field of decontamination of nuclear reactor primary systems. More specifically, it relates to a unique method of removing suspended and dissolved solids from chemical decontamination fluids.

2. Description Of The Prior Art

The problem of excessive personnel exposures caused by high background radiation levels in a nuclear reactor primary system, such as in pressurized water reactor (PWR) systems, and the resultant economic cost of requiring personnel rotation to minimize individual exposure is significant at many nuclear plants. These background levels are principally due to the buildup of corrosion products in certain areas of the plant. The buildup of corrosion products exposes workers to high radiation levels during routine maintenance and refueling outages. The long term prognosis is that personnel exposure levels will continue to increase.

As a nuclear power plant operates, the surfaces in the core and primary system corrode. Corrosion products, referred to as crud, are activated by transport of the corroded material to the core region by the reactor coolant system (RCS). Subsequent release of the activated crud and redeposition elsewhere in the system produces radiation fields in piping and components throughout the primary system, thus increasing radiation levels throughout the plant. The activity of the corrosion product deposits is predominately due to Cobalt 58 and Cobalt 60. It is estimated that 80–90% of personnel radiation exposure can be attributed to these elements.

One way of controlling worker exposure, and of dealing with this problematic situation, is to periodically decontaminate the nuclear steam supply system using chemicals, thereby removing a significant fraction of the corrosion product oxide films. Prior techniques had done very little to decontaminate the primary system as a whole, typically focusing only on the heat exchanger (steam generator) channel heads.

Two different chemical processes, referred to as LOMI (developed in England under a joint program by EPRI and the Central Electricity Generating Board) and CAN-DEREM (developed by Atomic Energy of Canada, Ltd.), have been used for small scale decontamination in the past. These processes are multi-step operations, in which various chemicals are injected, recirculated, and then removed by ion-exchange. Although the chemicals are designed to dissolve the corrosion products, some particulates are also generated. One method of chemical decontamination, focusing on the chemistry of decontamination, is disclosed in U.K. Patent Application No. GB 2 085 215 A (Bradbury et al.). There is little disclosure, however, of the methodology to be used in applying that chemistry to system decontamination.

While these chemical processes had typically been used on only a localized basis, use of these chemical processes has now been considered by the inventors herein for possible application on a large scale, full system chemical decontamination. Such an application is disclosed generally in co-pending Application Ser. No. 07/62/120 entitled "System For Chemical Decontamination Of Nuclear, Reactor Primary Systems", and incorporated herein by reference.

While some work has been done in the boiling water reactor (BWR) programs, the BWR scenarios examined by those in the field involved only decontaminating fuel assemblies in sipping cans employing commercial processes at off-normal decontamination process conditions with little regard for the effects of temperature, pressure, and flow that would be mandated by an actual application of the process to the full reactor system.

The estimated collective radiation dose savings over a 10-year period following decontamination is on the order of 3500–4500 man rem, depending upon whether or not the fuel is removed during decontamination. At any reasonable assigning of cost per man-rem, the savings resulting from reduced dose levels will be in the tens of millions of dollars.

As a result of the examination of potential full system decontamination, a need now exists for an effective and economic method to remove dissolved and particulated corrosion products generated by the application of the known chemical decontamination techniques from the chemically-injected primary system fluids.

SUMMARY OF THE INVENTION

The present invention is directed to a clean-up subsystem to be used in conjunction with a chemical decontamination system for full nuclear reactor primary system decontamination. The present invention allows for on-line decontamination. To this end, multiple banks of demineralizers are utilized in parallel. By alternating process flow between the multiple banks of demineralizers, the resin beds can be replaced during system operation. This leads to economies of scale, time, and cost.

A back-flushable filter is utilized to remove suspended solids prior to demineralizing of the dissolved solids. Additional filters can be provided prior to, or after, the demineralizing step to further remove suspended solids and resin fines.

The present system is designed to operate without significantly extending the time required for the decontamination operation, which is typically on the critical path downtime for a commercial PWR nuclear reactor.

Accordingly, it is an object of the present invention to provide a decontamination clean-up sub-system to economically and quickly remove suspended and dissolved solids generated during a chemical decontamination process used on a nuclear reactor primary system. These and further objects and advantages will be apparent to those skilled in the art in connection with the detailed description of the invention that follows.

DETAILED DESCRIPTION OF THE PREFERRED EMBODIMENTS

Figure 1:
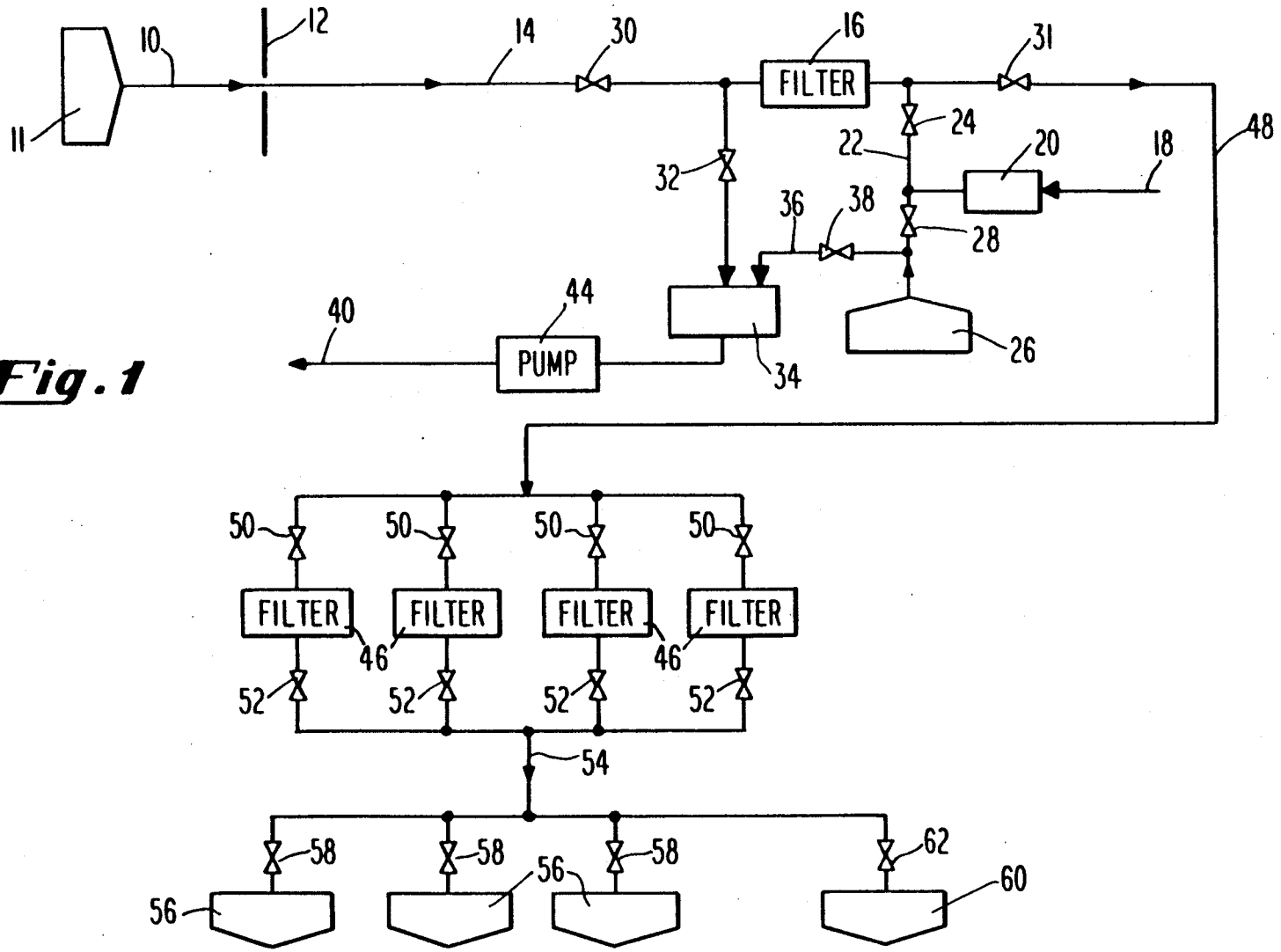
FIG. 1 is a schematic flow diagram illustrating a first portion of an embodiment of the apparatus of the present invention.
Figure 2:
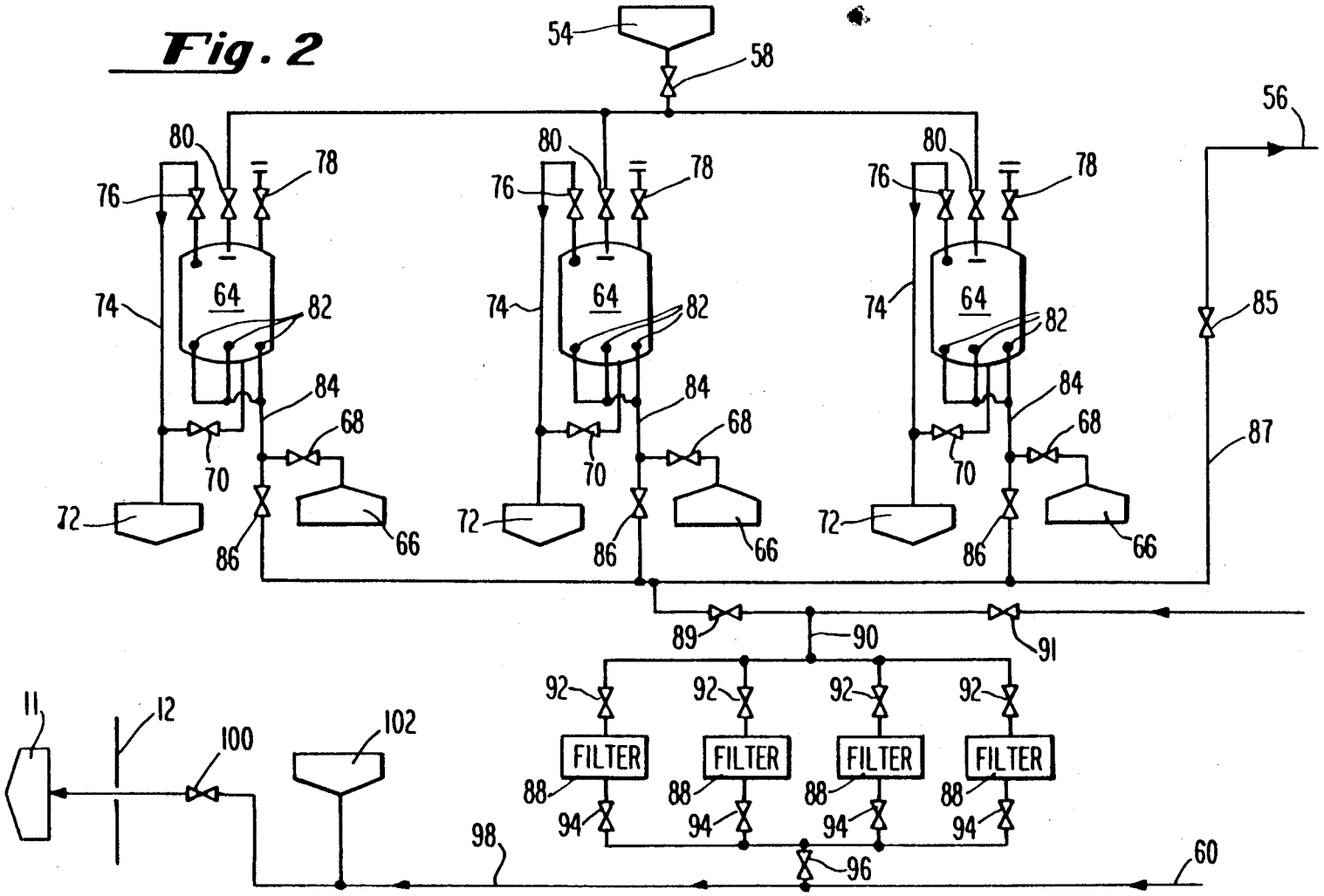
FIG. 2 is a schematic flow diagram illustrating the remaining portion of an embodiment of the apparatus of the present invention.

Turning in detail to the drawings, where like numbers refer to like items, FIGS. 1 and 2, in combination, represent a schematic flow diagram of one preferred embodiment of the present invention. Other configurations are possible and do not affect the method and apparatus of the present invention.

Referring now to FIG. 1, primary system process fluids containing suspended and dissolved solids from the chemical decontamination process are removed from the primary system of a nuclear reactor in fluid flow 10, which includes a means for providing a pressure head, passing out of the containment structure 12 of the nuclear reactor and into the chemical clean-up sub-system. The fluids flow through piping 14 into a back-flushable filter 16.

A pressure head needed for operation of the chemical clean-up sub-system is preferably provided in fluid flow 10 by one of the pumps already being used in a reactor auxiliary system. In one preferred embodiment the pressure head is provided by one or more of the residual heat removal system pumps. Further discussion of this aspect is included in co-pending Application Ser. No. 07/62/120.

Particulates generated by a standard contamination process will consist of metals (chromium, iron, and nickel) and manganese dioxide. Although the exact quantity of metals will depend upon the crud film thickness, the total quantity will typically be between 400 and 1,000 pounds (180 and 450 Kg). In normal operation of the decontamination system, the majority of this mass will be dissolved by the decontamination chemicals. As for the undissolved particulates, tests have shown that about 70% of the particles will be in the range of 2–8 microns, and their concentration within the process fluids will be in the range of 10–15 parts per million.

The manganese dioxide is generated during the alkaline/permanganate step that is common to both of the known CAN-DEREM and LOMI techniques. It is desireable to remove all of this manganese dioxide as particulates, rather than allowing it to become a dissolved solid as the result of its subsequent chemical steps since more solid wastes in the form of spent resin will be generated in removing it as a dissolved solid than would be generated in the form of a particulate slurry. The expected particle size of the manganese dioxide is in the range of 0.7–1.7 microns.

Based on the relatively high solids concentration, the large mass of solids would have an adverse effect on downstream resin beds in terms of excessive pressure drop or coating of the resins. Therefore, it is preferable to remove at least a substantial portion of the suspended solids prior to utilization of any ion-exchange, demineralization beds. Thus, a back-flushable filter capable of removing particles larger than about 10 microns is used. The limitation on the particle removal size is based on current filter technology, which indicates that back-wash efficiency is poor with filters rated below 5 or 10 microns. Other ratings are possible without departing from the principle of the present invention. A back-flushable filter 16 can be back-flushed with process fluid, demineralized water, or nitrogen, depending upon the design chosen. In a preferred embodiment, as shown in FIG. 1, nitrogen 18 is provided to a accumulator 20 for use in back-flushing via piping 22 and valve 24. A demineralized water source 26 can also be provided as needed via valve 28. If nitrogen is used to back-flush, a further flush with demineralized water is recommended. If process fluid is used, demineralized water is not necessary.

When back-flushing, the back-flushable filter 16, valves 30 and 31 will be closed and valve 32 will be opened to direct the back-flushed material to a filtrate collection tank 34. One or more of these valves may preferably be remotely operated as a motor valve or an air valve to minimize personnel radiation exposure. Demineralized water can also be directed to the filtrate collection tank 34 from the demineralized water source 26 by means of piping 36 and valve 38.

At a convenient time, the collected contents of the filtrate collection tank 34 can be removed. When the present clean-up sub-system is utilized in conjunction with the resin processing system described in co-pending Application Ser. No. 07/62/130 entitled "Resin Processing System," and incorporated herein by reference, the contents of the filtrate collection tank 34 can be directed to the spent resin storage tank 40 by means of piping 42 and pump 44. Pump 44 is preferably an air-operated diaphragm pump, which can operate to pump both wet and dry materials at low cost. In operation, the back-flushable filter 16 will typically be back-washed when the pressure drop across it reaches 20–25 psi (1000–1300 mmHg).

Because the procedures used in both the CAN-DEREM and LOMI processes extend over several days, it is expected that only a few back-washes will be necessary. Therefore, it is reasonable to size the filtrate collection tank 34 for a single back-wash.

One or more replaceable cartridge filters 46 are preferably located downstream of the back-flushable filter 16 to which the process fluids are directed by means of piping 48. At least two cartridge filters 46 are recommended, so that one can be changed while the other, or others, is in service. In the embodiment shown in FIG. 1, four cartridge filters 46 are shown, each having front close-off valves 50 and back close-off valves 52 so that individual cartridge filters 46 can be operated, or maintenance performed thereon, independently of the operation of the other cartridge filters 46.

One preferred filter media is polypropylene or glass fiber. Pleated paper is typically not acceptable because the decontamination chemicals of the standard processes will dissolve the paper. The cartridge filters will typically have a nominal one micron rating to allow for finer filtration of suspended solids. The combination of the back-flushable filter 16 and the cartridge filters 46 protect the downstream resin beds from fouling and high pressure drop.

After passage through the back-flushable filter 16 and the cartridge filters 46, the processed fluids are directed via piping 54 to one or more banks of demineralizers 56. The demineralizer banks 56 can be selectively chosen by means of valves 58. Additionally, the demineralizer banks 56 can be totally bypassed using bypass piping 60 and valve 62.

In a preferred embodiment when used with the CAN-DEREM chemical decontamination process, three banks of demineralizers 56 are aligned in parallel. Two of the banks would be aligned alternately for the alkaline/permanganate steps and a third bank would contain a smaller vessel or vessels called a Regen bed that would be dedicated to the regeneration step (when 70–80% of the curies will be removed from the primary system). When used in conjunction with the resin processing system described in co-pending Application Ser. No. 07/62/130, the first two banks of demineralizers 56 will require resin replacement while the third, the Regen bed, will not require resin replacement. When operating with the LOMI chemical decontamination process, the same two banks of demineralizers 56 wherein the resin is regenerated during operation can be used. The Regen beds are not required for the LOMI decontamination.

Looking now at FIG. 2, which focuses on one of the particular banks of demineralizers 56 that are suitable for replacement of resin during operation, the processed fluids are directed to the bank of demineralizers 56 via piping 54 and valve 58. The bank of demineralizers 56 will contain one or more resin bed tanks 64. The resin bed tanks 64 are uniquely sized and arranged in order to optimize a variety of factors including: total resin volume requirements; cation, anion, or mixed bed resin, depending upon the particular process step; resin bed replacement between process steps; adequate flow rate to achieve proper sub-system clean-up within a viable time period; use of multiple units for operating flexibility and ease of transport; and proper resin loading. A chosen arrangement should preferably not require numerous bed replacements since this would significantly affect the critical path time. The amount of resin loading should allow for sufficient residence time to obtain efficient ion exchange. It is preferable to achieve roughly 99% removal of any chemicals injected within the primary system in less than about 8 hours. Thus, a flow rate in the range of 1,000–1,500 gallons (3800–5700 liters) per minute will be necessary for a system volume of approximately 100,000 gallons (380 cubic meters).

Based on all of the above factors, the number of demineralizer banks 56 required in a preferred embodiment for each chemical process was determined as discussed above (three for CAN-DEREM and two for LOMI). Further, in one preferred embodiment as illustrated in FIG. 2 each of the demineralizer banks 56 contains three resin bed tanks 64 sized such that each resin bed tank 64 will only require resin replacement once during chemical decontamination.

While alternative arrangements are possible, it is preferable to utilize the resin processing system described in co-pending Application Ser. No. 07/62/130. Such a system provides sluice water 66 when needed through valves 68 to flush out the spent resin from the resin bed tank 64 through valve 70 and to a spent resin collection tank 72. Alternate flow for venting and other purposes, such as initial fluffing of the resin prior to removal, is provided by piping 74 and valve 76. Fresh resin can thereafter be provided to the resin bed tank 64 through valve 78.

In normal operation, the process fluids enter through piping 54 and valve 58 and are directed to one or more of the resin bed tanks 64 by use of valve 80. After undergoing ion exchange within the resin bed tanks 64 to remove dissolved solids, the processed fluid is removed via screened outlets 82 and piping 84 through valve 86. Valves 89 and 91 can be used to isolate fluid flow from individual demineralizer banks 56. An alternate line of piping 87 is arranged such that two demineralizer banks 56 can be operated in series with isolation valve 85. This configuration is useful when performing a LOMI-type decontamination process.

While the process fluids, after passing through the demineralizer banks 56 can be recycled directly to the primary system, in one preferred embodiment they are first sent through one or more resin fines filters 88 by means of piping 90. The resin fines filters 88 will catch resin fines from the resin bed tanks 64. This is especially preferable if several resin bed changeouts are performed during the course of a full chemical decontamination cycle. In addition, the resin fines filters 88 provide assurance that a resin bed tank 64 will not be accidentally dumped into the primary system by operator error during a resin bed replacement operation.

These resin fines filters 88 are typically cartridge filters that are replaceable and, thus, it is preferred that more than one such filter be provided. In FIG. 2, four resin fines filters 88 are depicted, each with front valves 92 and back valves 94 so that individual resin filters 88 can be closed off for replacement and maintenance purposes as well as for proper flow regulation. A filter rating of 25 microns or less is recommended.

After passing through the resin fines filters 88, the process fluid flows through isolation valve 96 and returns to the primary system 11 via piping 98 and valve 100. Again, these valves may preferably be remotely operated. Chemicals 102 for the chemical decontamination process can be injected just prior to return of the processed fluid to the primary system as necessary.

In a standard 5-step CAN-DEREM decontamination process, the resin replacement steps would be as follows: (1) Regeneration step: a first demineralizer bank 56 containing the Regen beds is aligned for service while the CAN-DEREM chemical is recirculated in the system. After the regeneration step, a second demineralizer bank 56 is aligned for removal of the CAN-DEREM chemical. After depletion, this second demineralizer bank 56 has its resin replaced. The time available to replace the resin within this second demineralizer bank 56 is about 15 hours. (2) After the alkaline/-permanganate step, flow is once again aligned through the second demineralizer bank 56 for clean-up. When the resin in this second bank 56 is exhausted, the bank is isolated, and a third demineralizer bank 56 is aligned. During the time that the third demineralizer bank 56 is in service, the resin can be replaced within the second demineralizer bank 56. The time available for this resin replacement is approximately 30 hours. The time thereafter available for the third demineralizer bank 56 resin replacement is 26 hours. (3) Repeat steps (1)–(2). (4) Repeat step (2). (5) Repeat step 1 except that there is no need to replace the resin within the second demineralizer bank 56 after the CAN-DEREM chemical clean-up.

Alternatively, when the standard LOMI chemical decontamination process is used, as mentioned, only two demineralizer banks 56 are required. The resin replacement steps for such a process would normally occur as follows: (1) After the alkaline/permanganate step, flow is aligned through the first demineralizer bank 56 for clean-up. When the resin is exhausted within this first demineralizer bank 56, this bank is isolated, and a second demineralizer bank 56 is aligned. The first demineralizer bank 56 can be replaced with resin for step (2) below during the time that the second demineralizer bank 56 is in service. The time available for resin replacement in the first demineralizer bank 56 is approximately 7 hours. (2) After the LOMI application, the first demineralizer bank 56, filled with cation resin, and the second demineralizer bank 56, filled with weak base anion resin, are aligned in series. For this reason resin replacement cannot begin until clean-up is completed. Each of the banks is replaced with resin for step (3) below. The time available for replacement of resin in the first demineralizer bank 56 is approximately 9 hours while the time available for replacement in the second demineralizer bank 56 is approximately 13 hours. (3) Repeat steps 1 and 2.

The apparatus and methods of the present invention are seen to provide significant advantages. Chemical decontamination fluids of any particular decontamination step can be cleaned-up of substantially all suspended and dissolved solids within a reasonable period of approximately 8 hours. The apparatus can be located outside the containment, thereby providing easier access for removal of solid waste. Further, by utilizing a pressure head provided by the primary system itself, overall costs can be minimized.

Thus, a clean-up sub-system of the present invention provides efficient, on-line removal of dissolved and suspended solids generated during decontamination of large volume pressurized water reactor fluid systems. It utilizes known technology in a unique arrangement to provide clean-up in a timely manner to minimize the overall scheduled requirements for large system decontamination.

Having thus described the invention, it is to be understood that the invention is not limited to the embodiments set forth herein for purposes of exemplification. It is to be limited only by the scope of the attached claims, including a full range of equivalents to which each claim thereof is entitled.

What is claimed is:

1. A chemical decontamination clean-up system for use on-line in a nuclear reactor primary system comprising:

a back-flushable filter;

means within the nuclear reactor primary system for pumping primary system fluids from the nuclear reactor primary system downstream to the back-flushable filter and thereafter through the decontamination system;

a plurality of demineralizer banks arranged in parallel, each demineralizer bank comprising one or more demineralizers arranged in parallel wherein primary system fluids are demineralized;

means for selectively directing the pumped primary system fluids from the back-flushable filter to a particular demineralizer bank; and means for returning primary system fluids from the demineralizer banks to the primary system.

2. The chemical decontamination clean-up system of claim 1 further comprising:

one or more post-filters arranged in parallel capable of removing smaller particulates from the primary system fluids than the back-flushable filter is capable of removing; and means for selectively directing the pumped primary system fluids from the back-flushable filter through one or more of the post-filters positioned upstream of the means for selectively directing the pumped primary system fluids to a particular demineralizer bank.

3. The chemical decontamination clean-up system of claim 1 wherein the back-flushable filter utilizes nitrogen gas for back-flushing.

4. The chemical decontamination clean-up system of claim 1 further comprising:

one or more resin fines filters arranged in parallel; and means for selectively directing the pumped primary system fluids from the demineralizers through one or more of the resin fines filters positioned upstream of the means for returning primary system fluids from the demineralizer banks to the primary system.

5. The chemical decontamination clean-up system of claim 1 further comprising a filtrate collection tank connected to the back-flushable filter to receive back-flushed particulates.

6. A chemical decontamination clean-up system for on-line use in a nuclear reactor primary system comprising:

a back-flushable filter that uses nitrogen gas for back-flushing;

a filtrate collection tank connected to the back-flushable filter to receive back-flushed particulates;

means within the nuclear reactor primary system for pumping primary system fluids from the nuclear reactor primary system to the back-flushable filter and thereafter through the decontamination system;

a plurality of post-filters arranged in parallel capable of removing smaller particulates from the primary system fluids than the back-flushable filter is capable of removing;

means for selectively directing the pumped primary system fluids from the back-flushable filter through one or more of the post-filters;

a plurality of demineralizer banks arranged in parallel, each demineralizer bank comprising a plurality of demineralizers arranged in parallel wherein primary system fluids are demineralized;

means for selectively directing the pumped primary system fluids from the post-filters to a particular demineralizer bank;

a plurality of resin fines filters arranged in parallel;

means for selectively directing the pumped primary system fluids from the demineralizers through one or more of the resin fines filters; and means for returning the primary system fluids from the resin fines filters to the primary system.

7. A nuclear reactor having a primary system wherein the primary system has an on-line chemical decontamination clean-up sub-system comprising:

a back-flushable filter;

means within the nuclear reactor primary system for pumping primary system fluids from the nuclear reactor primary system downstream to the back-flushable filter and thereafter through the decontamination system;

a plurality of demineralizer banks arranged in parallel, each demineralizer bank comprising one or more demineralizers arranged in parallel wherein primary system fluids are demineralized;

means for selectively directing the pumped primary system fluids from the back-flushable filter to a particular demineralizer bank; and means for returning primary fluids from the demineralizer banks to the primary system.

8. The nuclear reactor of claim 7 wherein the chemical decontamination clean-up sub-system further comprises:

one or more post-filters arranged in parallel capable of removing smaller particulates from the primary system fluids than the back-flushable filter is capable of removing; and means for selectively directing the pumped primary system fluids from the back-flushable filter through one or more of the post-filters positioned upstream of the means for selectively directing the pumped primary system fluids to a particular demineralizer bank.

9. The nuclear reactor of claim 7 wherein the back-flushable filter utilizes nitrogen gas for back-flushing.

10. The nuclear reactor of claim 7 wherein the chemical decontamination clean-up sub-system further comprises:

one or more resin fines filters arranged in parallel; and means for selectively directing the pumped primary system fluids from the demineralizers through one or more of the resin fines filters positioned upstream of the means for returning primary system fluids from the demineralizer banks to the primary system.

11. The nuclear reactor of claim 7 wherein the chemical decontamination clean-up sub-system further comprises a filtrate collection tank connected to the back-flushable filter to receive back-flushed particulates.

12. A method of removing suspended and dissolved solids for use in on-line chemical decontamination clean-up of nuclear reactor primary systems comprising the steps of:

pumping primary system fluids containing suspended solids, dissolved solids, or both, to a back-flushable filter for removal of suspended solids;

selectively feeding the filtered primary system fluids to one of a plurality of banks of demineralizers arranged in parallel, each such bank of demineralizers comprising one or more demineralizers arranged in parallel;

demineralizing the primary system fluids in the selected bank of demineralizers; and returning the filtered and demineralized primary system fluids to the nuclear reactor primary system.

13. The method of removing suspended and dissolved solids for use in chemical decontamination clean-up of nuclear reactor primary systems of claim 12 further comprising the step of directing the filtered primary system fluids from the back-flushable filter to one or more of a plurality of post-filters arranged in parallel for removal of smaller particulates than the back-flushable filter has removed prior to selectively feeding the filtered primary system fluids to one of the plurality of banks of demineralizers.

14. The method of removing suspended and dissolved solids for use in chemical decontamination clean-up of nuclear reactor primary systems of claim 12 further comprising the step of back-flushing the back-flushable filter periodically.

15. The method of removing suspended and dissolved solids for use in chemical decontamination clean-up of nuclear reactor primary systems of claim 14 wherein the step of back-flushing uses nitrogen gas.

16. The method of removing suspended and dissolved solids for use in chemical decontamination clean-up of nuclear reactor primary systems of claim 14 further comprising the step of collecting the back-flushed particulates in a filtrate collection tank connected to the back-flushable filter.

17. The method of removing suspended and dissolved solids for use in chemical decontamination clean-up of nuclear reactor primary systems of claim 12 further comprising the step of selectively directing the demineralized primary system fluids from the demineralizers to one or more resin fines filters arranged in parallel prior to returning the filtered and demineralized primary system fluids to the nuclear reactor primary system.

* * * * *